US009878428B2

(12) United States Patent
Lehnert et al.

(10) Patent No.: US 9,878,428 B2
(45) Date of Patent: Jan. 30, 2018

(54) WIRELESS TOOL SYSTEM

(71) Applicant: STANLEY BLACK & DECKER, INC., Towson, MD (US)

(72) Inventors: Mark W. Lehnert, The Villages, FL (US); John M. Schiappacasse, Farmington Hills, MI (US); Lawrence J. Lehnert, Canton, MI (US); Thomas M. Jones, Hartland, MI (US); Park Insik, New Albany, OH (US)

(73) Assignee: Stanley Black & Decker, Inc., New Britain, CT (US)

( * ) Notice: Subject to any disclaimer, the term of this patent is extended or adjusted under 35 U.S.C. 154(b) by 0 days.

(21) Appl. No.: 14/896,560

(22) PCT Filed: Jun. 12, 2014

(86) PCT No.: PCT/US2014/042113

§ 371 (c)(1),
(2) Date: Dec. 7, 2015

(87) PCT Pub. No.: WO2014/201243

PCT Pub. Date: Dec. 18, 2014

(65) Prior Publication Data

US 2016/0129569 A1 May 12, 2016

Related U.S. Application Data

(60) Provisional application No. 61/834,643, filed on Jun. 13, 2013.

(51) Int. Cl.

| | |
|---|---|
| ***B25B 23/142*** | (2006.01) |
| ***B25B 13/46*** | (2006.01) |
| ***G08C 17/02*** | (2006.01) |

(52) U.S. Cl.
CPC ..... *B25B 23/1425* (2013.01); *B25B 13/463* (2013.01); *G08C 17/02* (2013.01); *G08C 2201/30* (2013.01)

(58) Field of Classification Search
CPC ... B25B 13/463; B25B 23/1425; G08C 17/02; G08C 2201/30
USPC ..... 340/12.54
See application file for complete search history.

(56) References Cited

U.S. PATENT DOCUMENTS

| | | | | |
|---|---|---|---|---|
| 4,244,434 | A | 1/1981 | Wilson | |
| 4,558,601 | A | 12/1985 | Stasiek et al. | |
| 4,880,064 | A | 11/1989 | Willoughby et al. | |
| 6,234,051 | B1 | 5/2001 | Bareggi | |
| 6,276,243 | B1 * | 8/2001 | Jenkins | B25B 23/1427 81/479 |
| 6,463,834 | B2 * | 10/2002 | Kemp | B25B 23/1427 81/467 |
| 7,021,180 | B2 | 4/2006 | Crane | |
| 7,089,834 | B2 | 8/2006 | Reynertson et al. | |

(Continued)

FOREIGN PATENT DOCUMENTS

| | | |
|---|---|---|
| DE | 10051011 | 4/2002 |

OTHER PUBLICATIONS

European Search Report dated Jan. 25, 2017.

*Primary Examiner* — Nader Bolourchi
(74) *Attorney, Agent, or Firm* — Caeden Drayton; Adan Ayala

(57) ABSTRACT

A torque wrench includes a solenoid driven release mechanism and a transceiver for wirelessly transmitting and receiving parameter set.

21 Claims, 8 Drawing Sheets

(56) References Cited

U.S. PATENT DOCUMENTS

| | | | |
|---|---|---|---|
| 7,090,030 | B2 | 8/2006 | Miller |
| 7,174,818 | B1 | 2/2007 | Cutler et al. |
| 7,182,147 | B2 | 2/2007 | Cutler et al. |
| 7,685,889 | B2 | 3/2010 | Hsieh |
| 7,819,025 | B2 | 10/2010 | Coffland |
| 7,823,485 | B2 | 11/2010 | Rainone |
| 7,878,076 | B2 | 2/2011 | Lucke et al. |
| 7,896,098 | B2 | 3/2011 | Suzuki et al. |
| 7,954,557 | B2 | 6/2011 | Cutler et al. |
| 7,984,657 | B2 | 7/2011 | DeRose et al. |
| 8,096,211 | B2 | 1/2012 | Cho et al. |
| 8,171,828 | B2 | 5/2012 | Duvan et al. |
| 8,172,607 | B2 | 5/2012 | Chiapuzzi |
| 8,215,187 | B2 | 7/2012 | Chen |
| 8,281,871 | B2 | 10/2012 | Cutler et al. |
| 8,327,741 | B2 | 12/2012 | Hsieh |
| 8,443,703 | B2 | 5/2013 | Chen |
| 8,555,755 | B2 | 10/2013 | Cattaneo |
| 8,584,554 | B2 | 11/2013 | Chen |
| 8,797,114 | B2 | 8/2014 | Chiapuzzi |
| 2005/0092143 | A1 | 5/2005 | Lehnert et al. |
| 2006/0076385 | A1 | 4/2006 | Etter et al. |
| 2008/0115636 | A1 | 5/2008 | DeRose et al. |
| 2008/0127711 | A1 | 6/2008 | Farag |
| 2009/0217788 | A1* | 9/2009 | Hunter ..... E21B 19/16 81/57.33 |
| 2009/0241743 | A1 | 10/2009 | Hsieh |
| 2009/0249924 | A1 | 10/2009 | Lin |
| 2010/0154599 | A1* | 6/2010 | Gareis ..... B25B 23/14 81/54 |
| 2010/0170370 | A1 | 7/2010 | Yokoyama et al. |
| 2010/0216415 | A1 | 8/2010 | Arimura et al. |
| 2010/0269646 | A1 | 10/2010 | Le Du et al. |
| 2011/0132157 | A1 | 6/2011 | Duvan et al. |
| 2011/0180517 | A1* | 7/2011 | Schneider ..... B23K 9/1006 219/108 |

* cited by examiner

WIRELESS TOOL SYSTEM

BACKGROUND OF THE INVENTION

1. Field of the Invention

The present invention relates to a tool system, and, more particularly, to a wireless tool system that includes one or more tools configured to communicate wirelessly with at least one other communication device.

2. Description of the Related Art

One type of prior art torque wrench includes a rotatable handle to mechanically adjust the stiffness of a spring to adjust the desired torque set point of the torque wrench. In one such prior art torque wrench, mechanical components are configured to generate an audible click and to produce a power gap of several degrees of rotation of the tool handle that produces no rotation of the fastener being tightened, which signals the operator to stop applying torque to the fastener.

A torque wrench has been contemplated that includes electrical components to detect the applied torque and to signal the operator that the torque set point has been reached. The torque wrench may be set up for a data exchange with an external device.

BRIEF DESCRIPTION THE DRAWINGS

Figure 3:
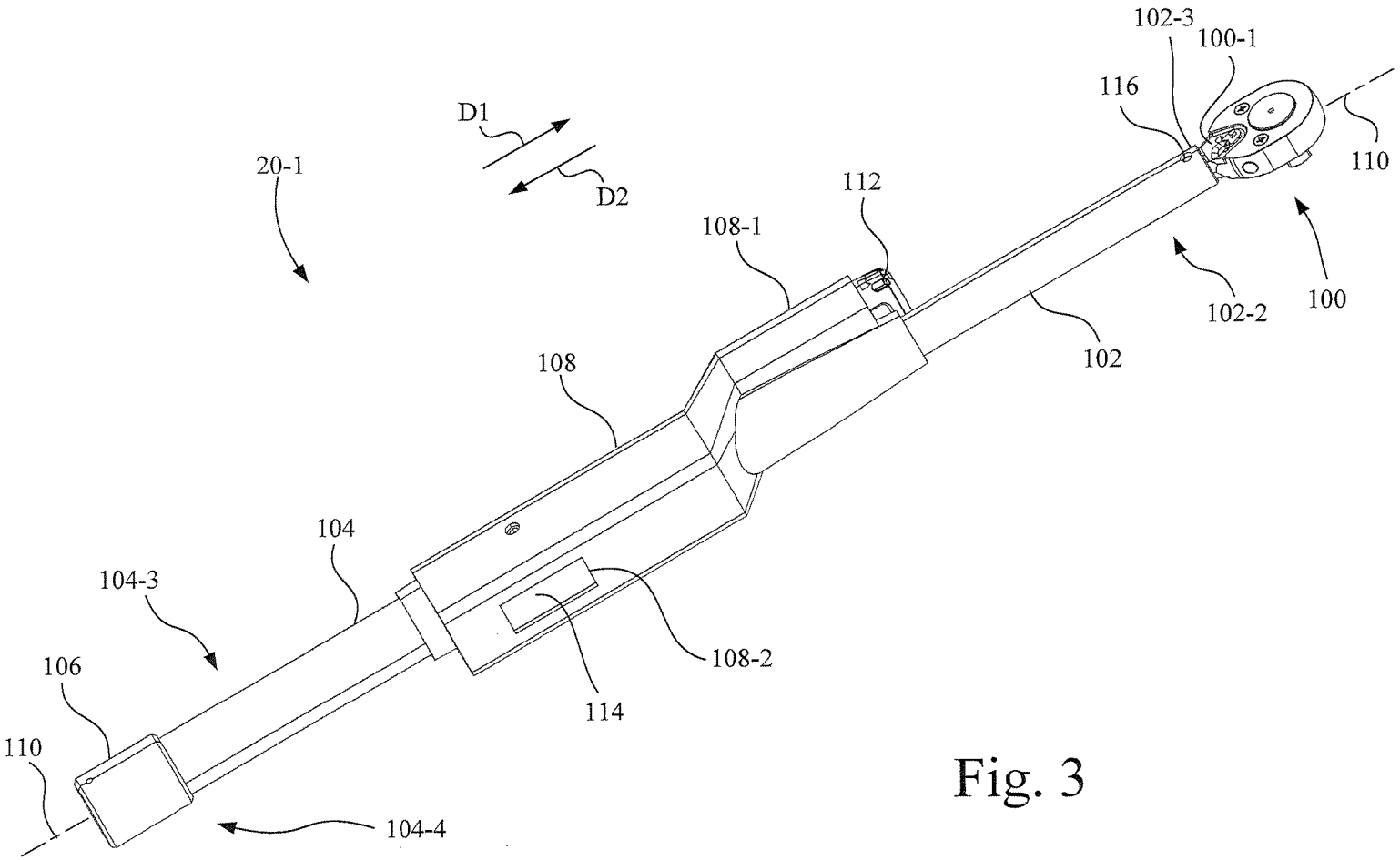
FIG. 3 is a perspective view of the wireless torque wrench of the wireless tool system of FIG. 1 in an orientation opposite to that of FIG. 2.
Figure 4:
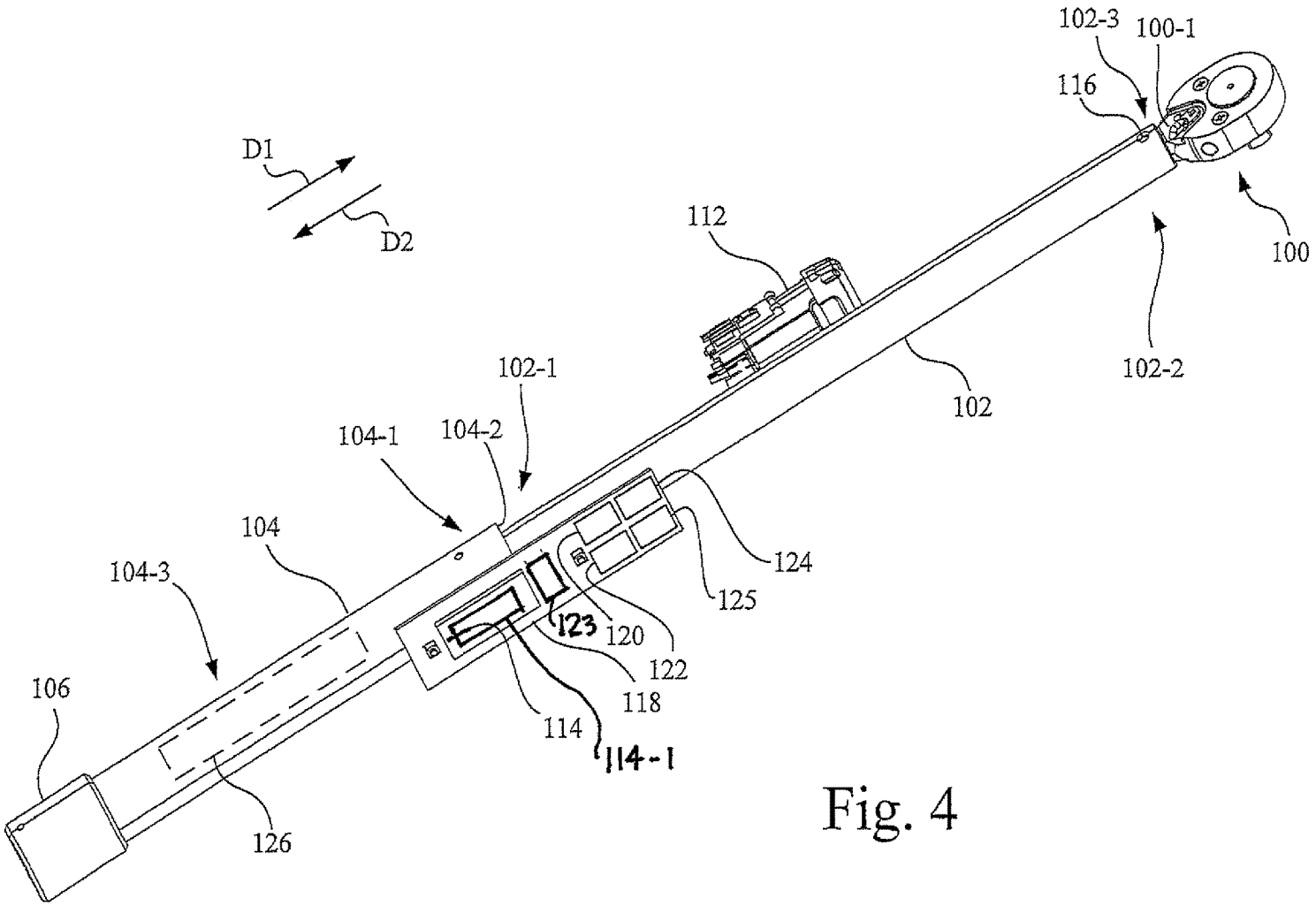

FIG. 4 corresponds to the perspective view of the wireless torque wrench of FIG. 3 with the intermediate housing removed to expose the controller circuit board and the battery pack.

Figure 2:
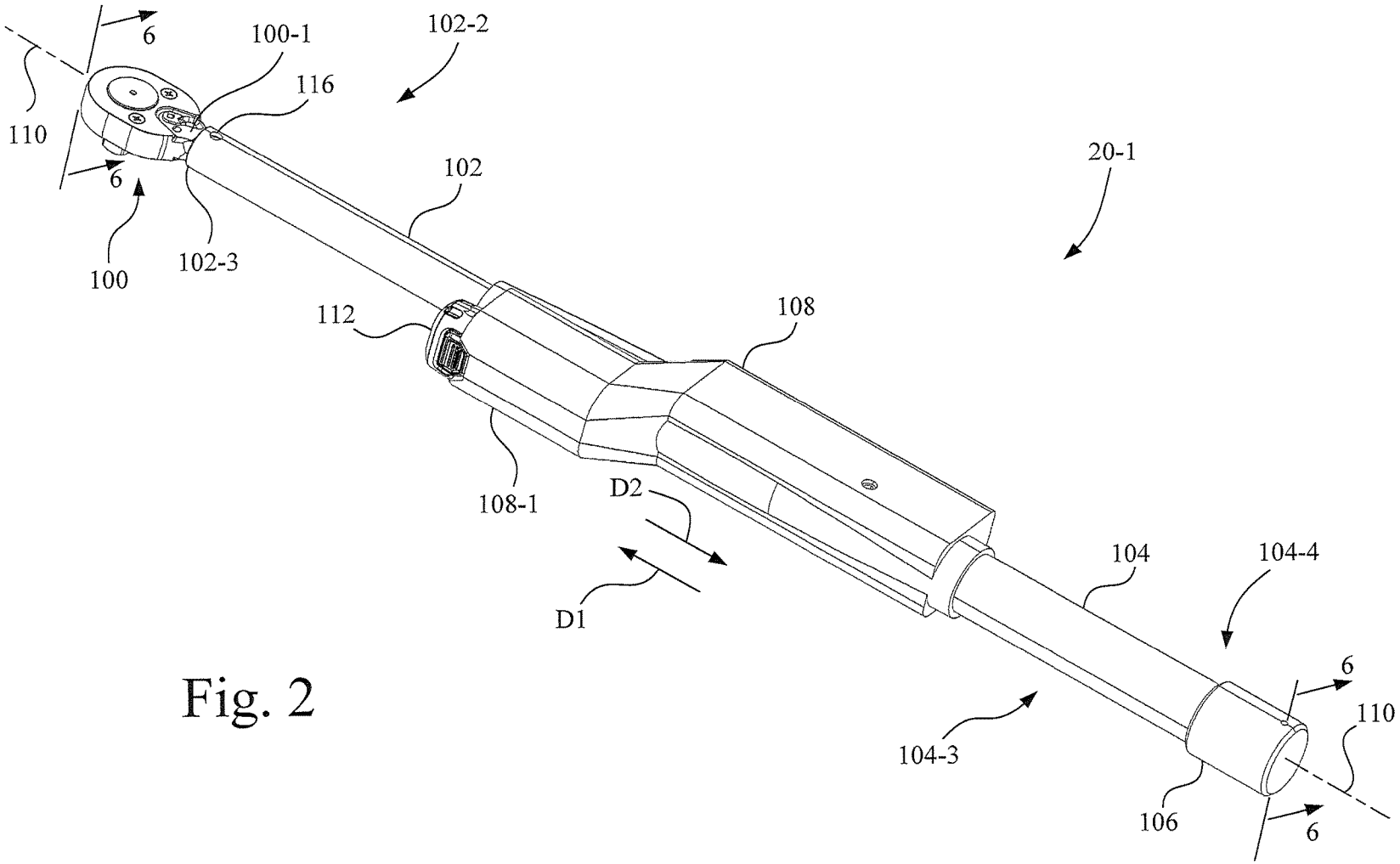
FIG. 2 is a perspective view of a wireless torque wrench of the wireless tool system of FIG. 1.
Figure 5:
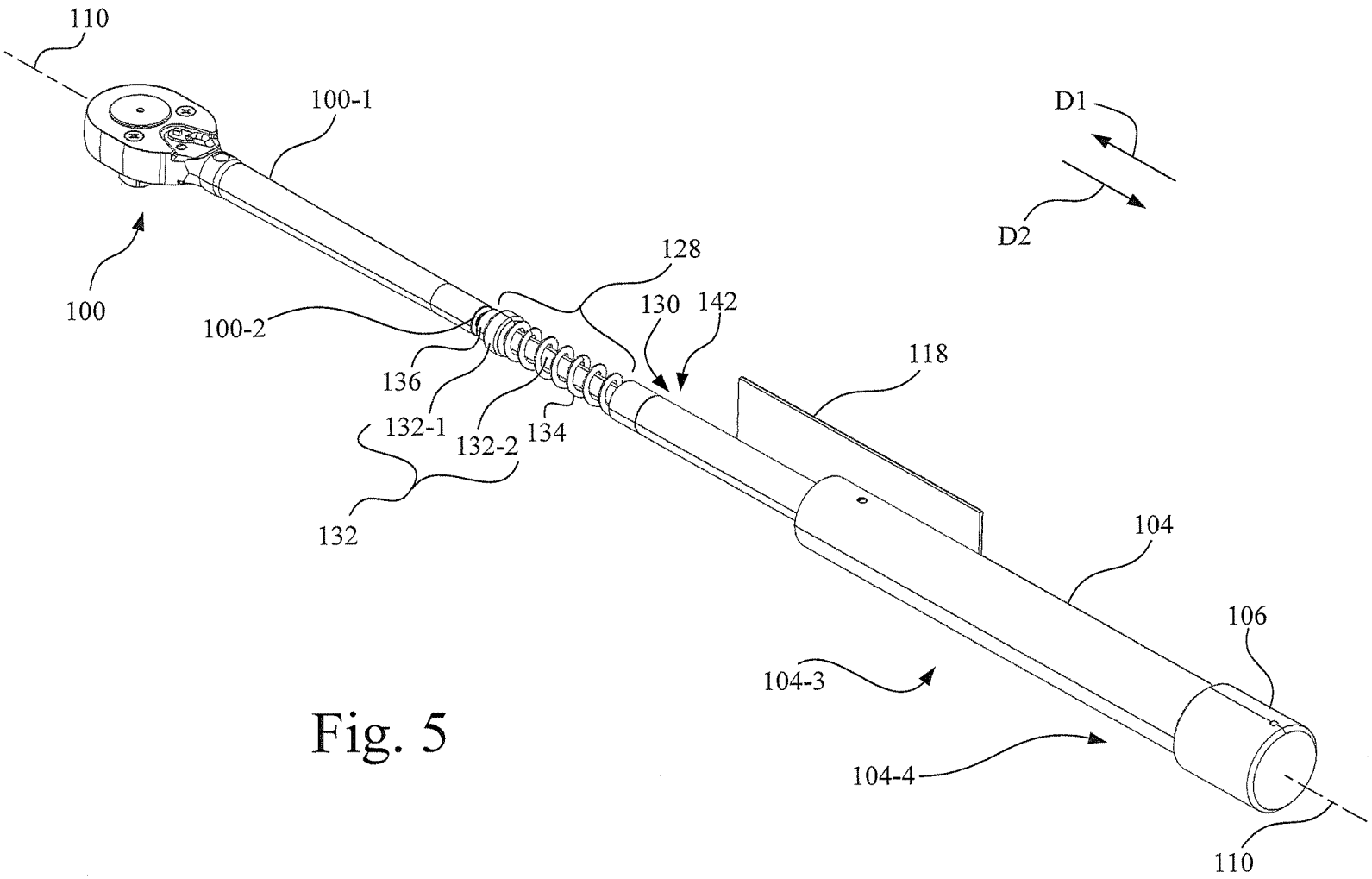

FIG. 5 corresponds to the perspective view of the wireless torque wrench of FIG. 2 with the intermediate housing, battery pack and the elongate handle tube removed to expose the cam mechanism and the electrically actuated release mechanism.

Figure 6:
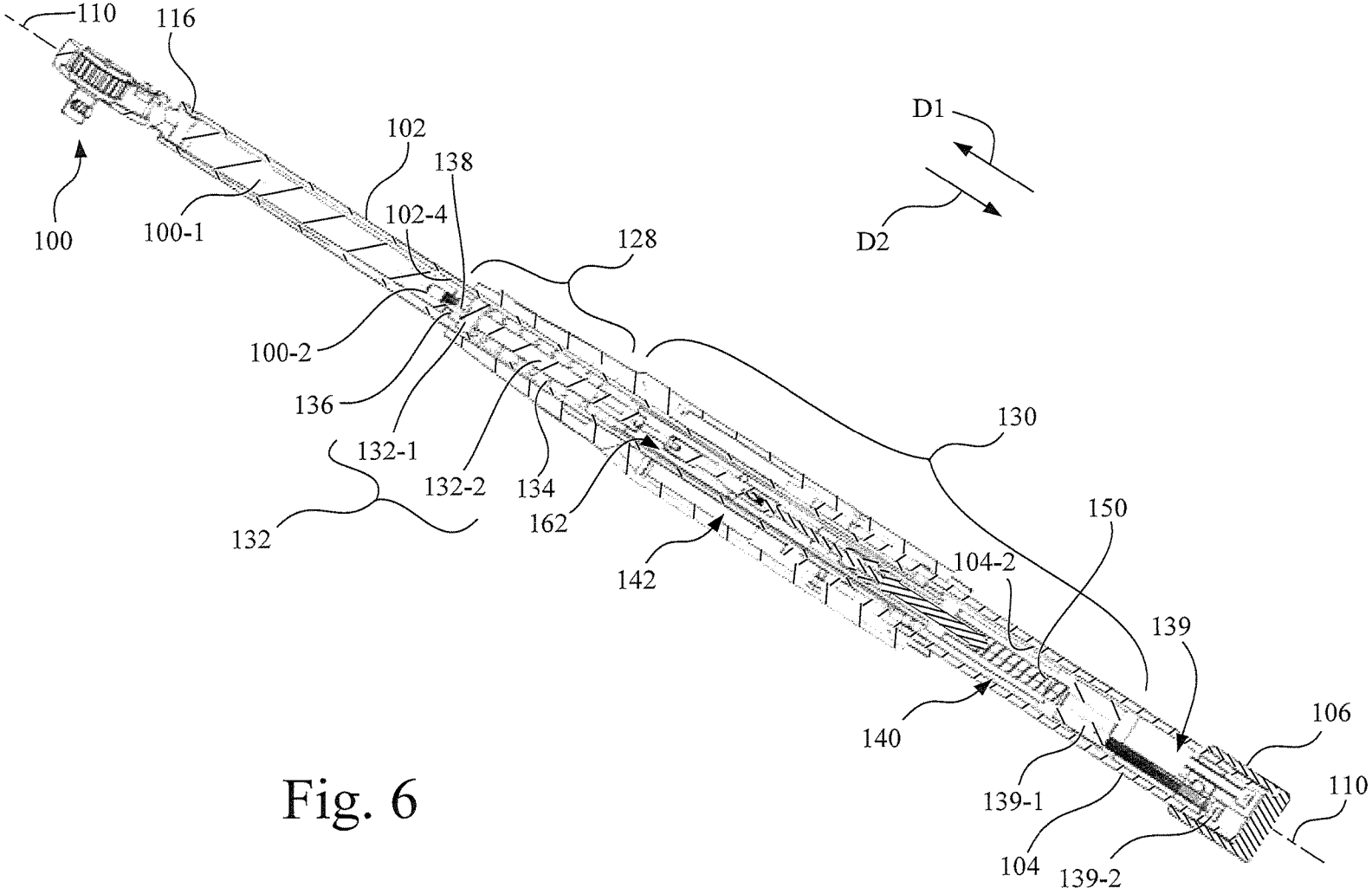
Figure 7:
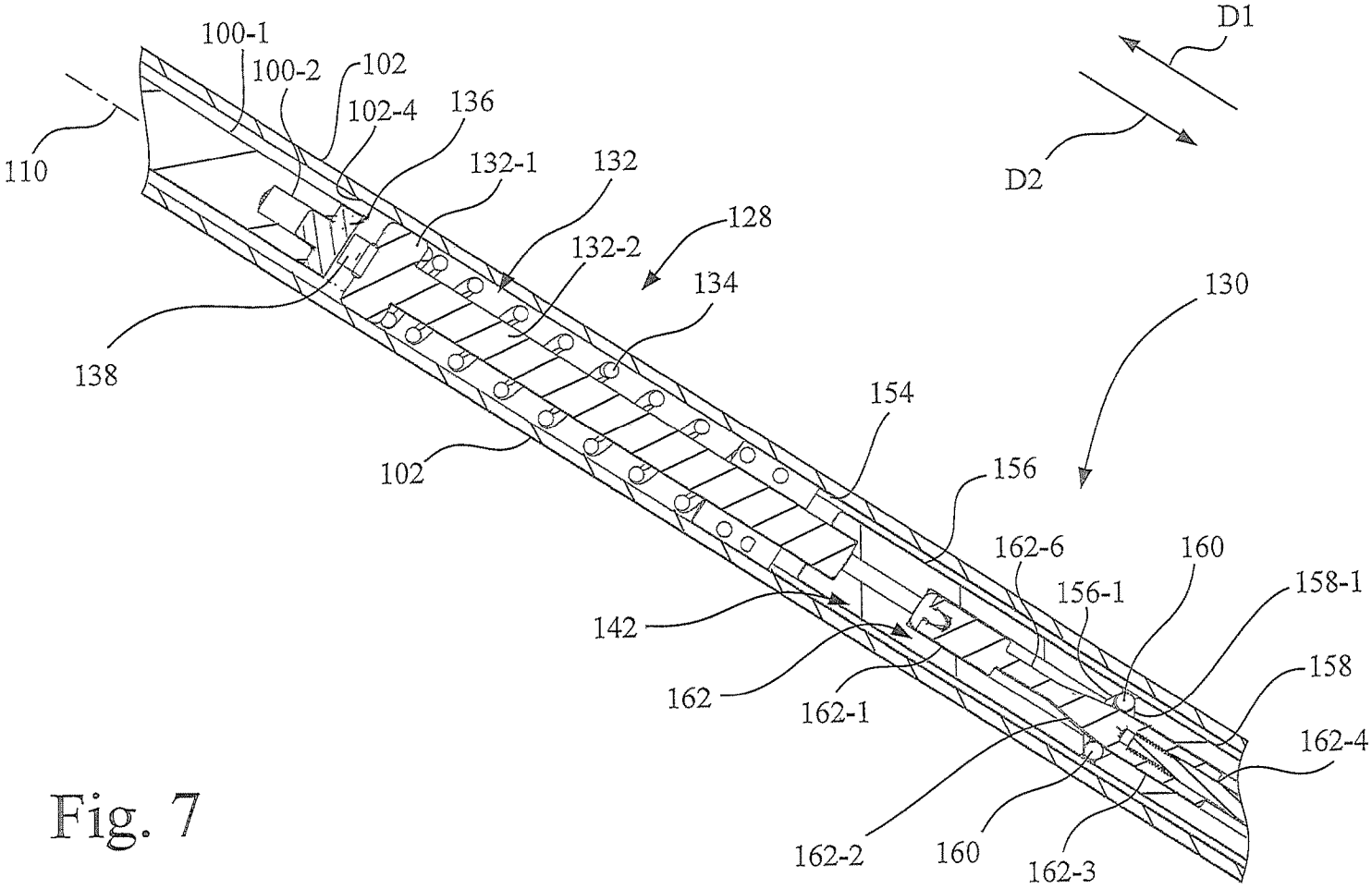

FIG. 6 is a sectioned perspective view of the torque wrench taken along plane FIG. 7 is enlarged portion of the sectioned perspective view of FIG. 6 that shows the cam mechanism in greater detail, in conjunction with a portion of the electrically actuated release mechanism.

Figure 8:
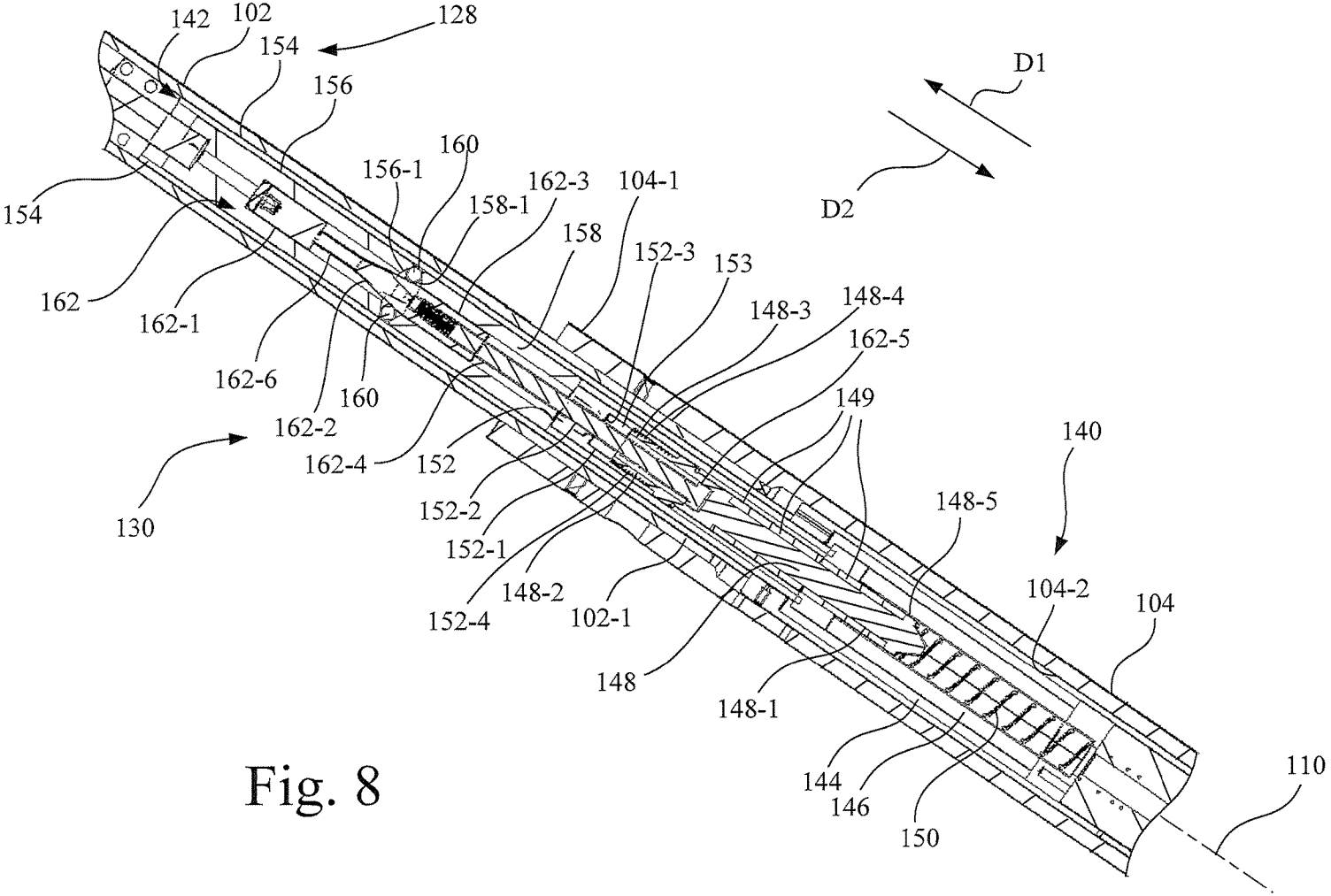

FIG. 8 is enlarged portion of the sectioned perspective view of FIG. 6 that shows the electrically actuated release mechanism in greater detail, in conjunction with a portion of the cam mechanism.

Corresponding reference characters indicate corresponding parts throughout the several views. The exemplifications set out herein illustrate an embodiment of the invention, and such exemplifications are not to be construed as limiting the scope of the invention in any manner.

DESCRIPTION OF THE INVENTION

Figure 1:
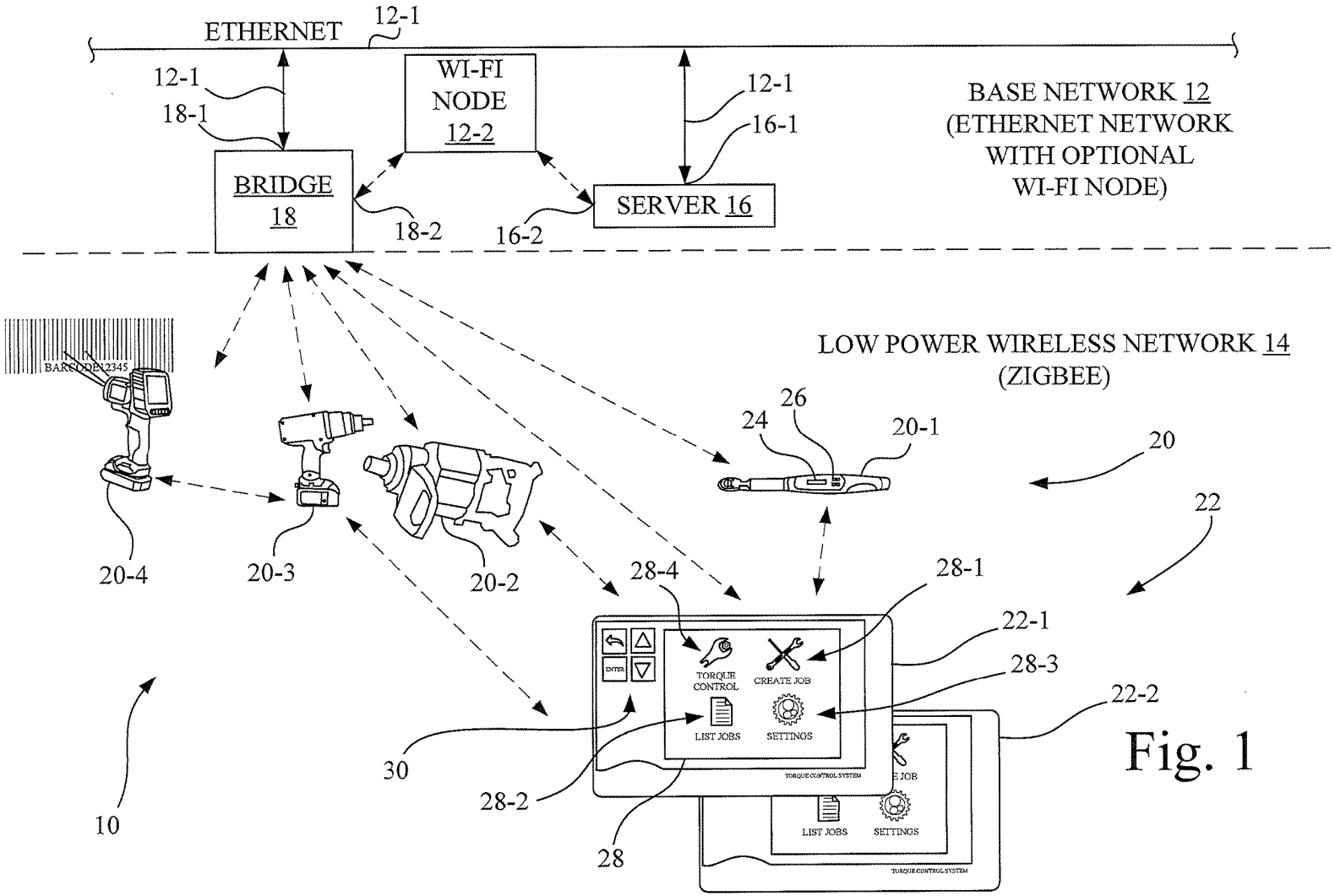
FIG. 1 is a block diagram of a wireless tool system configured in accordance with an aspect of the present invention.

Referring now to the drawings and particularly to FIG. 1, there is shown a wireless tool system 10 in accordance with an aspect of the present invention.

Wireless tool system 10 may be used, for example, to monitor and facilitate the tightening of fasteners. For example, the system may be used in the automotive industry for tracking the task of installing wheels on an automobile, or may be used in the oil industry to track the connecting of flanged pipes together in the oil fields.

Wireless tool system 10 includes a base network 12 and a low power wireless network 14.

Base network 12 may be configured as an Ethernet network 12-1, and may include a Wi-Fi node 12-2. As shown for example in FIG. 1, base network 12 includes a server 16 and a bridge 18. The wired Ethernet communication in base network 12 corresponds to the standardized IEEE 802.3 protocol. The wireless Wi-Fi communication in base network 12 is configured to operate using a wireless protocol based on IEEE 802.11. It is contemplated that the Wi-Fi node 12-2 may be incorporated into one of server 16 and bridge 18, if desired, to serve as a Wi-Fi hotspot for base network 12.

In the configuration as shown, server 16 may be a computer (e.g., desktop with monitor and keyboard, laptop, tablet, etc.) having at least one Ethernet port 16-1 and/or at least one wireless Wi-Fi port 16-2. In practice, server 16 may be, for example, a customer point-of-sale terminal. Sever 16 is configured to provide a web browser to access the bridge 18 to create jobs and review job completion data.

Bridge 18 is configured as a gateway, or network hub, to communicate with both base network 12 and low power wireless network 14, and is configured to facilitate communication between the wireless components of low power wireless network 14 (e.g., tools and portable communication devices) and the wired and/or wireless components of base network 12 (e.g., server 16). Thus, all communication between base network 12 and low power wireless network 14 will pass through bridge 18.

Bridge 18 includes at least one Ethernet port 18-1 and/or at least one wireless Wi-Fi port 18-2. Accordingly, communication between server 16 and bridge 18 in base network 12 may be facilitated by a wired Ethernet connection to Ethernet network 12-1, or alternatively, may be facilitated wirelessly via Wi-Fi node 12-2. Bridge 18 may provide a web interface for computer (e.g., server 16) users to create jobs and to review job completion data.

Low power wireless network 14 is configured to facilitate communication using a low power wireless network communications protocol, such as for example, the ZigBee protocol that builds upon the physical layer and medium access control defined in IEEE 802.15.4. Low power wireless network 14 includes one or more tools 20 and one or more portable communication devices 22, also referred to herein as pucks 22, individually identified as 22-1, 22-2, each being configured for communication with bridge 18 and tools 20 via the low power wireless network communications protocol. In addition, each of tools 20 and pucks 22 may be configured to provide communication repeating capability, so as to be able to extend the overall communication range of low power wireless network 14 by serving as an intermediate signal repeater to bridge 18.

In the configuration of FIG. 1, bridge 18 is configured with the ability to bridge information between server 16 of base network 12 and multiple potential recipients, e.g., tools 20 and pucks 22, of low power wireless network 14.

In wireless tool system 10, the tools 20 may be, for example, a handheld torque wrench 20-1, a pneumatic or battery powered heavy duty impact tool 20-2, a light duty impact tool 20-3, etc., and may further include a barcode scanner 20-4. Each of the tools 20 is configured for wireless communication using the low power wireless network communications protocol, e.g., ZigBee. Using torque wrench

20-1 as an example, each of the tools 20 may include a display 24 and an input 26, e.g., buttons or touch screen, so as to facilitate inputting information at the respective tool 20, and to initiate communication between the respective tool 20 and a wireless device, e.g., bridge 18 and/or pucks 22. The respective tool 20 is configured to send or receive communications with another device, such as indirectly with server 16 via bridge 18, directly with bridge 18, or directly with one or more of the pucks 22. In general, tools 20 wirelessly receive and transmit selected parameter sets, such as job initiation data and job completion data.

Each of the portable communication devices (pucks) 22-1, 22-2, is a small, portable, battery operated wireless terminal that includes a touch screen display providing input and display capability. Each of the pucks 22 includes a wireless communication transceiver and a processor that may include a microprocessor and associated memory, and includes programmed instructions to facilitate input, display and communication functions. For example, each puck 22-1, 22-2 includes a radio frequency (r.f.) transceiver, a processor unit, and all the interface items such as lights, buttons, a graphic display and audible alarm and/or voice generator required to communicate with the tools 20 and the bridge 18, and directly to the puck operator.

As shown in FIG. 1, for example, puck 22-1 includes a main menu screen 28 that includes a "create job" icon 28-1, a "list jobs" icon 28-2, a "setting" icon 28-3, and a "torque control" icon 28-4. Each of the icons 28-1, 28-2, 28-3, 28-4, as well as a user interface button pad 30 having control buttons, are linked as inputs to the microprocessor of the processor unit and when actuated are processed via the programmed instructions, so as to, for example, select a next screen associated with icons 28-1, 28-2, 28-3, 28-4, or to navigate within a screen. When a selection is made which requires a wireless transmission from puck 22-1, such wireless transmission occurs automatically.

The "create job" icon 28-1 may be used to open screens to start a new job, as an alternative to starting a new job at server 16.

The "list jobs" icon 28-2 may be used to open screens to view the available jobs, or to modify, an existing job.

The "settings" icon 28-3 may be used to open screens to modify the operational settings of a particular tool 20.

For a torque application, the "torque control" icon 28-4 may be used to set the torque at a desired target torque set point for handheld torque wrench 20-1, for heavy duty impact tool 20-2, or for light duty impact tool 20-3, to be used on a particular job. Alternatively, or supplemental to torque control icon 28-4, user interface button pad 30 may be used to manually enter torque information, e.g., the target (maximum) torque set point.

An exemplary automotive tire replacement job requiring a wheel re-installation will now be described to aid in understanding the operation of wireless tool system 10, as a typical exemplary sequence of events.

Consider a scenario in which a customer buys a new tire at an automotive service store having wireless tool system 10 installed. After completing the service transaction, the point-of-sale computer (server 16) executes program instructions to generate a message which is sent to bridge 18 via one of Ethernet network 12-1 or Wi-Fi node 12-2. Bridge 18 may be mounted, for example, on a wall or ceiling of the shop area where the tire is to be installed. The bridge 18 has the ability to distribute information between many operators e.g., automotive technicians, on the service floor of the shop (via tools 20 and pucks 22) and the point-of-sale computer (server 16). The message sent by server 16 contains an identifier, such as a license plate number, as well as a parameter set. The "parameter set" is a structured pattern that defines the tightening requirements for each fastener, e.g., lug nut. In the present example, the parameter set will be: the number of lug nuts per wheel (e.g., five), the torque setting to which each lug nut is to be tightened (e.g., 100 foot-pounds), the number of wheels to be serviced (e.g., one), and if less than all the wheels, then the wheel to be serviced (e.g., left rear).

Each operator, e.g., automotive technician, in the shop area is issued a respective puck 22, and in this example the automotive technician will have been issued puck 22-1. The automotive technician assigned to perform the current job operates the issued puck 22-1 to find the vehicle, e.g., by license plate number, by selecting the list jobs icon 28-2 to display the jobs on puck 22-1. Once the job is associated with the proper vehicle in the shop, the automotive technician removes the designated wheel, and installs a new tire on the rim of the wheel.

It is noted that there are many tools 20 of various types and sizes in the shop. The automotive technician must select an appropriately sized tool 20 for the reinstallation of the wheel. Assume first that the automotive technician inappropriately selects a large 1000 ft lb impact tool 20-2 used for installing wheels on large commercial vehicles and presses the "Select Tool" button 26 on impact tool 20-2. Impact tool 20-2 then identifies itself to puck 22-1. Puck 22-1 compares the selected tool 20-2 with the job requirements and determines that impact tool 20-2 is inappropriate for the job. Puck 22-1 then sounds an audible alarm and generates a visual or audio message to indicate to the automotive technician that the selected impact tool 20-2 is an inappropriately sized tool for the job.

Now realizing the error, the automotive technician selects a different tool, this time a 50 to 200 ft-lb handheld torque wrench 20-1. The automotive technician presses the "Select Tool" button 26 on torque wrench 20-1, and torque wrench 20-1 then identifies itself to puck 22-1. Puck 22-1 considers the tool selection and puck 22-1 determines that torque wrench 20-1 is appropriate for the job. Puck 22-1 may then generate a visual or audio message to indicate to the automotive technician that it is safe to proceed.

As each lug nut is tightened, torque data is transmitted from torque wrench 20-1 to puck 22-1. When all of the lug nuts associated with the wheel have been properly tightened to the proper torque, puck 22-1 recognizes that the requirements of the parameter set have been achieved and uploads the data associated with the job to bridge 18. Puck 22-1 may also generate a visual or audio message to indicate to the automotive technician that the job is complete. Bridge 18 then relays the job completion information back to the point-of-sale computer (server 16) over Ethernet 12-1 or Wi-Fi 12-2, to generate a torque report for the job.

Server 16 may then add this information to a local database, which may be associated with the customer and the vehicle for future reference.

Referring now to FIGS. 2-8, torque wrench 20-1 will be described in greater detail.

Referring first to FIGS. 2-4, torque wrench 20-1 includes a ratchet head 100, an elongate handle tube 102, an outer handle tube 104, an electromechanical torque adjustment knob 106, and an intermediate housing 108 arranged along a longitudinal axis 110. Elongate handle tube 102 and outer handle tube 104 are coaxial, with a proximal end 102-1 of elongate handle tube 102 being inserted into a distal end 104-1 of outer handle tube 104. Housing 108 includes a battery receptacle 108-1 configured to receive a rechargeable battery pack 112. Referring to FIG. 3, housing 108 includes a window 108-2 that defines the location of a display screen 114.

Ratchet head 100 has a standard square drive, and includes a shaft portion 100-1 that is received in a distal end portion 102-2 of elongate handle tube 102. Ratchet head 100 is pivotably connected to distal end portion 102-2 near a distal end 102-3 of elongate handle tube 102 by a pin 116 that is oriented transverse to longitudinal axis 110. Pin 116 passes through, e.g., by a press-fit, a set of aligned holes respectively formed in elongate handle tube 102 and ratchet head 100.

Referring to FIG. 4, torque wrench 20-1 is shown with housing 108 removed to expose a controller circuit board 118 to which display screen 114 is mounted. Display screen 114 may be in the form of a touch screen, and may include illuminators (e.g., LEDs 114-1), for providing visual feedback to the operator of torque wrench 20-1.

Controller circuit board 118 is electrically connected to the battery pack 112. Illustrated diagrammatically on controller circuit board 118 is a processing unit 120, a communications unit 122, a gyro unit 124, and a sound generator 125 (e.g., beeper, voice generator, speaker, etc.), each of which being electrically powered by the battery pack 112. Processing unit 120 is communicatively connected to each of communications unit 122, gyro unit 124, and sound generator 125. It is additionally contemplated that torque wrench 20-1 may include a vibratory feedback device 123 also in electrical communication with processing unit 120.

Gyro unit 124 provides tool orientation feedback data to processing unit 120. The tool orientation feedback data may include, for example, an indication of the direction of rotation of handle tubes 102, 104 relative to ratchet head 100, as well as the torque wrench rotation angle.

A strain gauge 126 is positioned along the longitudinal extent of outer handle tube 104 on an interior surface 104-2 of outer handle tube 104 at a desired location, such as for example near a mid-point 104-3 of outer handle tube 104. Outer handle tube 104 serves as the handgrip location for the operator. Strain gauge 126 may be one of multiple strain gauges, configured to sense the torque that is delivered to ratchet head 100 from outer handle tube 104, and provide an electrical strain output signal to processing unit 120 of controller circuit board 118, which in turn processes the strain output signal and converts the strain value into a torque value, e.g., foot-pounds.

Referring also to FIG. 1, communications unit 122 is a transceiver having a radio frequency (r.f.) communications chip set configured to communicate via the low power wireless network 14, e.g., ZigBee, with the pucks 22 or bridge 18 in a manner as described above, via data packets. Information received via communications unit 122 that is designated in the data packet as being directed to torque wrench 20-1 is then processed by processing unit 120. Incoming data packets to communications unit 122 may include, for example, target torque set points, limits, and job sequence information. Outgoing data packets from communications unit 122 may include, for example, torque data, tool cycle status, etc., for the job performed.

Processing unit 120 may include, for example, a microprocessor and associated semiconductor memory and input/output (I/O) drivers, and may be in the form of an application specific integrated circuit (ASIC). The I/O drivers of processing unit 120 are in electrical communication with the electromechanical torque adjustment knob 106, with display screen 114, gyro unit 124, sound generator 125, and strain gauge 126. Processing unit 120 is configured to store any outgoing data until communication between communications unit 122 and one or more of the pucks 22, or bridge 18, is established.

Display screen 114 may be a touch screen to allow data input, or alternatively torque wrench 20-1 may utilize manual buttons 26, as illustrated in FIG. 1, to provide input, e.g., data selection, to processing unit 120. For example, a desired torque value may be input to torque wrench 20-1 wirelessly via one of the pucks 22, or alternatively, manually via the electromechanical torque adjustment knob 106. The torque input then may be processed by processor unit 120 for display on display screen 114. Torque information displayed on display screen 114 may include, for example, the instantaneous applied torque, the target (e.g., maximum) torque set point, etc. As an alternative to, or supplemental to, utilizing display screen 114 on torque wrench 20-1, the torque information may be displayed on the user's puck 22-1.

Referring also to FIGS. 5-8, the internal construction of torque wrench 20-1 will now be described.

Torque wrench 20-1 includes a cam mechanism 128 and an electrically actuated release mechanism 130. Electrically actuated release mechanism 130 is configured to release cam mechanism 128 when the torque sensed by strain gauge 126 reaches the preset torque set point. Cam mechanism 128 is configured to provide an audible "click" and a "power gap" in a range of two to four degrees of rotation of the tool handle tubes 102, 104 during which there is no rotation of the fastener being tightened, so as to provide both an audible and tactile indication to the operator to stop applying torque to the fastener.

Cam mechanism 128 includes a T-shaped torque plunger 132, a spring 134, a ratchet head shaft insert 136, and a rotation block 138. T-shaped torque plunger 132 may be in the form of a bolt having a head 132-1 from which there longitudinally extends a shaft 132-2 having a threaded distal end. A spring 134 is positioned over shaft 132-2, and is located between head 132-1 and the electrically actuated release mechanism 130. Cam mechanism 128 further includes a ratchet head shaft insert 136 that is slidably disposed in an open proximal end 100-2 of shaft portion 100-1 of ratchet head 100. Interposed between ratchet head shaft insert 136 and head 132-1 of T-shaped torque plunger 132 is a rotation block 138 having four flats.

Once a torque exerted on ratchet head 100 reaches the predetermined torque set point, the spring force exerted by spring 134 is overcome and the rotation block 138 is rotated off of its flats by a pivoting of shaft portion 100-1 of ratchet head 100 about pin 116, thus permitting shaft portion 100-1 of ratchet head 100 to quickly pivot about pin 116 to be off-axis from longitudinal axis 110 at which time ratchet head shaft insert 136 strikes an inner surface 102-4 of elongate handle tube 102, thereby generating a "click". Also, a "power gap" is experienced by the torque wrench operator during the pivoting of the shaft portion 100-1 of ratchet head 100 from initially being on-axis with longitudinal axis 110 until the contact of ratchet head shaft insert 136 with the inner surface 102-4 of elongate handle tube 102. Thus, rotation block 138 serves as a "torque bridge" to immediately rotate at the point that the target torque set point is achieved, thereby preventing a further torque increase, and facilitating a signaling to the operator that the target torque has been reached and that the operator should cease further application of increased torque.

A calibration assembly 139 is provided at the proximal end 104-4 of outer handle tube 104 for manually adjusting the stiffness of spring 134 through a pressure block 139-1 to a minimum "set threshold" via an adjusting screw 139-2.

This establishes the absolute minimum operating level of torque wrench 20-1 as well as defines an adequate reaction energy to cycle the cam mechanism 128 to reset rotation block 138 back to the home position (on flats as shown in FIGS. 6 and 7) as the operator reduces the applied torque after a tightening cycle.

Referring now to FIGS. 6-8, the electrically actuated release mechanism 130 includes an electrically actuated solenoid 140 and a mechanical release assembly 142.

Referring now particularly to FIGS. 6 and 8, electrically actuated solenoid 140 includes a solenoid housing 144 having a hollow coil core 146. Positioned in the hollow coil core 146 is an actuator shaft or solenoid element 148. Actuator shaft 148 has a proximal portion 148-1 and a distal portion 148-2 having a distal bore 148-3 and external threads 148-4. Positioned over proximal portion 148-1 is a plurality of permanent magnets 149 and a proximal end cap 148-5. A reset spring 150 is received in hollow coil core 146 to engage the proximal end cap 148-5 to bias actuator shaft 148 distally in distal direction D1.

A slide-hammer end cap 152 defines a primary bore 152-1 and a secondary bore 152-2. Primary bore 152-1 defines a distal end wall 152-3 that radially extends between primary bore 152-1 and secondary bore 152-2. Slide-hammer end cap 152 is threadably connected at a proximal portion 152-4 of slide-hammer end cap 152 to external threads 148-4 of distal portion 148-2 of actuator shaft 148, with primary bore 152-1 of slide-hammer end cap 152 and distal bore 148-3 of actuator shaft 148 combining to form a slide-hammer chamber 153.

Referring again also to FIG. 7, mechanical release assembly 142 includes a sleeve 154 that contains a forward cylinder 156 and a rearward cylinder 158. A plurality of balls 160, e.g., steel ball bearings, is disposed between forward cylinder 156 and rearward cylinder 158. The present embodiment includes four balls 160 (only two show), but the number of balls 160 may be three or more, depending on the size of the torque wrench. Forward cylinder 156 has a proximal end 156-1 that defines a beveled contact surface for engaging balls 160. Also, rearward cylinder 158 has distal end 158-1 that defines a beveled contact surface for engaging balls 160. Movably disposed within and extending between forward cylinder 156 and rearward cylinder 158 is a release rod assembly 162.

Release rod assembly 162 includes, as an elongate unitary assembly, a distal piston 162-1, a tapered mandrel portion or release assembly tapered element 162-2 (forming a wedge), a proximal piston 162-3, a shaft extension 162-4 and a side-hammer head 162-5. Tapered mandrel portion 162-2 is interposed between distal piston 162-1 and proximal piston 162-3, with the taper narrowing in the direction toward distal piston 162-1 to define a recessed landing 162-6.

Thus, in the configuration as shown, as release rod assembly 162 is biased by spring 150 in distal direction D1, the balls 160 are radially outwardly extended by riding up the ramp provided by tapered mandrel portion 162-2 to a steady state radial position at the intersection of the tapered mandrel portion 162-2 and proximal piston 162-3. As such, the balls 160 are forced radially outwardly to be positioned between the beveled proximal end 156-1 of forward cylinder 156 and the beveled distal end 158-1 of rearward cylinder 158, thereby separating the beveled proximal end 156-1 of forward cylinder 156 and the beveled distal end 158-1 of rearward cylinder 158.

Slide-hammer head 162-5 of release rod assembly 162 is positioned in slide-hammer chamber 153 formed by the primary bore 152-1 of slide-hammer end cap 152 and distal bore 148-3 of actuator shaft 148 of the electrically actuated solenoid 140. Shaft extension 162-4 of release rod assembly 162 extends distally from slide-hammer head 162-5 and passes through the secondary bore 152-2 of slide-hammer end cap 152, such that slide-hammer head 162-5 of release rod assembly 162 is movable axially within slide-hammer chamber 153, yet is axially retrained within slide-hammer chamber 153.

A distal end of shaft extension 162-4 is connected with the proximal end of proximal piston 162-3, and thus projects slide-hammer head 162-5 a distance from the proximal piston 162-3, such that side-hammer head 162-5 is positioned at the proximal extent of distal bore 148-3 of slide-hammer chamber 153. Spring 150 bias actuator shaft 148 in distal direction D1, which in turn forces proximal piston 162-3 forward to ensure that balls 160 separate forward cylinder 156 and rearward cylinder 158 prior to a target torque set point being reached.

During operation of torque wrench 20-1, as torque is being applied by the operator to outer handle tube 104, the strain gauge(s) 126 send instantaneous torque level information to processing unit 120, where an instantaneous torque value is generated and compared to the target torque set point contained in the parameter set that previously was either wirelessly transmitted to torque wrench 20-1 by one of the pucks 22 or input directly to torque wrench 20-1 via electromechanical torque adjustment knob 106. When the instantaneous torque value equals the target torque set point, processing unit 120 sends an energizing signal to hollow coil core 146 to energize electrically actuated solenoid 140.

Thus, in accordance with the arrangement of electrically actuated release mechanism 130 described above, when solenoid 140 is energized (e.g., by a momentary electrical pulse having a duration of one millisecond or less) the hollow coil core 146 generates a magnetic field which in turn acts on permanent magnets 149 to swiftly retract actuator shaft 148 in proximal direction D2. In turn, actuator shaft 148 axially displaces slide-hammer end cap 152 in a slide-hammer-type fashion such that distal end wall 152-3 of slide-hammer end cap 152 abruptly impacts side-hammer head 162-5 of release rod assembly 162 to axially displace tapered mandrel portion 162-2, thereby radially releasing balls 160 such that balls 160 escape from between forward cylinder 156 and rearward cylinder 158. The escape of balls 160 from between forward cylinder 156 and rearward cylinder 158 in turn allows proximal end 156-1 of forward cylinder 156 to abruptly move in proximal direction D2 toward distal end 158-1 of rearward cylinder 158. This action in turn releases rotation block or element 138 of cam mechanism 128 to rotate, so as to facilitate generation of a loud audible "click" and a "power gap" associated with reaching the target torque set point, thereby signaling to the operator that the target torque has been reached and to suspend adding torque to the current fastener.

When the torque being applied by the operator to outer handle tube 104 is released, release rod assembly 162 is biased by spring 150 in the distal direction D1, at which time the balls 160 are radially displaced outwardly by riding up the ramp provided by tapered mandrel portion 162-2 to the steady state radial position at the intersection of the tapered mandrel portion 162-2 and proximal piston 162-3. As such, the balls 160 are forced radially outwardly to be positioned between the beveled proximal end 156-1 of forward cylinder 156 and the beveled distal end 158-1 of rearward cylinder 158, thereby separating the beveled proximal end 156-1 of forward cylinder 156 and the beveled distal end 158-1 of rearward cylinder 158, and thus resetting torque wrench 20-1 to be ready for the next torque operation.

Torque and angle data collected by processing unit 120 during that tool cycle is then transmitted wirelessly via communications unit 122 of torque wrench 20-1 and low power wireless network 14 to the associated puck(s) 22, e.g., one of puck 22-1 or puck 22-2. At the completion of the job, the associated puck 22 then wirelessly transfers the job information via low power wireless network 14 to bridge 18, which in turn transfers the job data via base network 12 to server 16 (see FIG. 1).

Thus, advantageously, the present invention provides a wireless tool system, and facilitates entry and exchange of tool information via wireless communication. Also, the wireless torque wrench is configured to electronically momentarily release the applied torque to generate the audible click and the power gap thus indicating that the target torque set point has been reached.

While this invention has been described with respect to an embodiment of the invention, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

The invention claimed is:

1. A tool, comprising:

a housing;

at least one mechanism operatively coupled to the housing for performing a job;

a display operatively coupled to the housing for presenting parameter set information of the job performed;

an input mechanism coupled to the display for selectively inputting a parameter set into the tool to initiate the job; and a communication device configured to wirelessly transmit and receive selected parameter sets of the job performed;

a processing unit coupled to the housing and to a source of electrical energy;

wherein the communication device includes a wireless transceiver coupled to the housing and operatively associated with the processing unit.

2. The tool of claim 1, further comprising:

wherein the processing unit is configured to receive a parameter set from the wireless transceiver and a first signal from a strain gauge indicative of the torque acting on the tool and to send a release signal to a release, the release including a solenoid element disposed for movement along a longitudinal axis, and a wedge moving longitudinally in response to the movement of the solenoid element along the longitudinal axis.

3. The tool of claim 2, wherein the input mechanism includes a touch screen.

4. The tool of claim 1, wherein the tool produces an indication from at least one of a sound generator, a vibratory feedback device, and an illuminator.

5. The tool of claim 2, wherein the release being configured to release an element of a cam mechanism in response to the first signal from the strain gauge.

6. The tool of claim 2, wherein:

the release includes a release assembly; and wherein the wedge includes a tapered element of the release assembly.

7. The tool of claim 1, further comprising:

the parameter set includes at least one of the type and size of the tool, and further includes data pertaining to the job;

the transceiver is configured to transmit elements of the parameter set to one or more wireless portable communication devices, the one or more wireless portable communication devices being configured to receive the parameter set and to communicate with the wireless transceiver; and wherein the one or more wireless portable communication devices are further configured to notify an operator as to whether the tool is appropriate for the job, responsive to a communication from the wireless transceiver.

8. The tool of claim 7, wherein the one or more wireless portable communication devices are further configured to receive parameter sets from, and to transmit parameter sets to, one of a bridge and at least one other wireless portable communication device.

9. The tool of claim 8, wherein the one or more wireless portable communication devices are further configured to transmit and receive parameter sets to and from, respectively, a server via the bridge.

10. The tool of claim 9, wherein the server includes a point-of-sale computer.

11. The tool of claim 9, wherein the server is configured to transmit a parameter set associated with the job to the bridge, and the bridge is configured to communicate the parameter set to the one or more wireless portable communication devices.

12. The tool of claim 8, wherein the tool is one of a plurality of tools operatively associated with each portable communication device and with the bridge.

13. A tool configured to perform a job, comprising:

a housing;

at least one mechanism operatively coupled to the housing for performing the job;

a display operatively coupled to the housing for presenting parameter set information of the job performed;

an input mechanism operatively associated with the display for selectively inputting a parameter set into the tool to initiate the job; and a wireless communication device configured to transmit data to at least one of a base network and a low-power wireless network;

a processing unit coupled to the housing and to a source of electrical energy;

wherein the wireless communication device includes a transceiver coupled to the housing and operatively associated with the processing unit wherein data communicated among the tool and the at least one of the base network and the low-power wireless network relates to a set of parameters for the job to be performed by the tool and to the tool's ability to perform the job within the set of parameters.

14. The tool of claim 13, wherein data transmitted from the tool to the at least one of the base network and the low-power wireless network relates to the tool's beginning of the job, the tool's progress toward completion of the job, and the tool's completion of the job.

15. A tool configured to perform a job, comprising:

a housing;

at least one mechanism operatively coupled to the housing for performing the job;

a display operatively coupled to the housing for presenting parameter set information of the job performed;

an input mechanism operatively associated with the display for selectively inputting a parameter set into the tool to initiate the job; and a wireless communication device configured to receive and transmit data to and from, respectively, at least one of a base network and a low-power wireless network;

a processing unit coupled to the housing and to a source of electrical energy;

wherein the wireless communication device includes a transceiver coupled to the housing and operatively associated with the processing unit wherein data communicated among the tool and the at least one of the base network and the low-power wireless network relates to a set of parameters for the job to be performed by the tool and to the tool's ability to perform the job within the set of parameters.

16. The tool of claim 15, wherein the wireless low-power network includes one or more tools.

17. The tool of claim 16, wherein the at least one of the base network and the wireless low-power network are configured to wirelessly communicate with any of the one or more tools.

18. The tool of claim 17, wherein the wireless low-power network further includes one or more portable wireless communication devices.

19. The tool of claim 18, wherein the one or more portable wireless communication devices are configured to be able to ascertain, upon receipt of data from the tool, that the tool does not have the ability to perform the job.

20. The tool of claim 17, wherein the base network includes a bridge operatively associated with a server.

21. The tool of claim 18, wherein one or more of the tools and the wireless portable communication devices are configured to provide communication repeating capability, so as to be able to extend the overall communication range of the low-power wireless network by serving as intermediate signal repeaters to a bridge.

* * * * *